US007766399B2

(12) United States Patent
Howey

(10) Patent No.: US 7,766,399 B2
(45) Date of Patent: Aug. 3, 2010

(54) DOOR SET WITH MAGNETIC ACTUATOR

(76) Inventor: Kevin Howey, 22 Southwood Court, Kitchener, ON (CA) N2E 2H9

( * ) Notice: Subject to any disclaimer, the term of this patent is extended or adjusted under 35 U.S.C. 154(b) by 0 days.

(21) Appl. No.: 12/366,144

(22) Filed: Feb. 5, 2009

(65) Prior Publication Data

US 2009/0195000 A1 Aug. 6, 2009

Related U.S. Application Data

(60) Provisional application No. 61/026,200, filed on Feb. 5, 2008.

(51) Int. Cl.
*E05C 17/56* (2006.01)
*E05C 19/16* (2006.01)

(52) U.S. Cl. ..... 292/251.5; 292/1.5; 292/169

(58) Field of Classification Search ..... 292/251.5, 292/DIG. 56, 1.5, 169
See application file for complete search history.

(56) References Cited

U.S. PATENT DOCUMENTS

| | | | | | |
|---|---|---|---|---|---|
| 1,194,636 | A | * | 8/1916 | Joy | 292/163 |
| 2,073,149 | A | * | 3/1937 | Geyer | 292/337 |
| 2,219,186 | A | | 10/1940 | Hornfeck | |
| 2,586,900 | A | | 2/1952 | Alderman | |
| 2,694,592 | A | | 11/1954 | Borchers et al. | |
| 2,797,655 | A | * | 7/1957 | Morehouse | 109/63.5 |
| 3,107,934 | A | | 10/1963 | Lee | |
| 3,334,936 | A | * | 8/1967 | Hekelaar et al. | 292/251.5 |
| 3,350,127 | A | * | 10/1967 | Hekelaar | 292/251.5 |
| 3,413,026 | A | | 11/1968 | Kendrick et al. | |
| 3,516,701 | A | | 6/1970 | Graham | |
| 3,794,366 | A | | 2/1974 | Graham | |
| 5,029,912 | A | * | 7/1991 | Gotanda | 292/143 |
| 5,106,134 | A | * | 4/1992 | Thau | 292/216 |
| 5,261,713 | A | | 11/1993 | Fischbach | |
| 5,362,116 | A | | 11/1994 | Doyle et al. | |
| 6,151,754 | A | * | 11/2000 | Chen | 16/85 |
| 6,561,555 | B1 | | 5/2003 | Millard | |
| 6,630,877 | B2 | * | 10/2003 | Manthey | 335/205 |
| 7,044,511 | B2 | | 5/2006 | Kliefoth et al. | |

(Continued)

FOREIGN PATENT DOCUMENTS

| | | | |
|---|---|---|---|
| DE | 145325 | * | 12/1902 |

(Continued)

OTHER PUBLICATIONS

PCT International Searching Authority (Canada), Written Opinion of the International Searching Authority, PCT International Application No. CA2009/000138, May 19, 2009.

*Primary Examiner*—Carlos Lugo
(74) *Attorney, Agent, or Firm*—Borden Ladner Gervais LLP; Jeffrey W. Wong

(57) ABSTRACT

The invention is directed at a door set assembly comprising a latch portion; a first magnetic material, located within the latch portion; a strike plate, the strike plate including a plate portion and a latch receiving portion; a second magnetic material, located within the latch receiving portion, the second magnetic material having a polarity opposite the first magnetic material; wherein when a door is closed, the magnets attract each other thereby pulling the latch portion into the latch receiving portion to secure the door closed. The door set assembly can also include a cushioned portion which fits within the latch receiving portion.

8 Claims, 3 Drawing Sheets

U.S. PATENT DOCUMENTS

| | | | | |
|---|---|---|---|---|
| 7,332,990 | B2 * | 2/2008 | Lo et al. | 335/205 |
| 2007/0007775 | A1 * | 1/2007 | Gallas et al. | 292/251.5 |
| 2007/0194578 | A1 * | 8/2007 | Boosey et al. | 292/251.5 |

FOREIGN PATENT DOCUMENTS

| | | | |
|---|---|---|---|
| DE | 10216718 | 10/2003 | |
| JP | 03212589 A | * | 9/1991 |
| JP | 5340149 | * | 12/1993 |

* cited by examiner

DOOR SET WITH MAGNETIC ACTUATOR

CROSS-REFERENCE TO RELATED APPLICATIONS

This application claims the benefit of priority of U.S. Provisional Patent Application No. 61/026,200 filed Feb. 5, 2008, which is incorporated herein by reference in its entirety.

FIELD OF THE INVENTION

This invention relates generally to door sets, and particularly to a door latch which is magnetically actuated.

BACKGROUND OF THE INVENTION

Although there are many types of door latches available, they generally fall into two main types. The first type has a door knob or the like for turning about an axis passing through the door. The door knob is coupled to a latch bolt such that on turning the knob, the latch bolt is withdrawn to open the door. A second type has a handle which is pivoted about an axis parallel to a face of the door to release the latch bolt so that the door can be opened.

In most latch mechanisms there is provided a latch which is spring loaded to project from a body into the door frame. The latch is depressed as the door swings into the frame and is spring actuated once the door is in the closed position back into the door frame. The latch can be retracted from the frame by turning the door knob. This leaves the latch projecting when the door is standing partially or entirely open and may interfere with the passage of goods or people through the door opening.

In many instances the spring mechanism is stiff so that closing the door and engaging the latch requires considerable force. The subsequent force required and the latching of the spring loaded latch produces an undesirable noise, such as a click.

Therefore, there is provided a novel door set with magnetic actuator which overcomes disadvantages of the prior art.

SUMMARY OF THE INVENTION

Existing door latches tend to be noisy. It is one object of the invention to provide a door latch which is more silent than known door latches. It is another object of the invention to provide an improved latch mechanism with easily movable parts that are light in weight.

In one embodiment, the magnetic latch of the invention has a magnet unit in the door frame and a magnetic latch unit located within a swinging door mounted to the door frame. The latch unit is a sliding piece which is actuated magnetically that moves in and out of a body mounted inside the door and is magnetically responsive to the magnet latch unit in the door frame.

The latch of the invention includes a sliding latch interconnected to a cam and a release and is magnetically charged and is recessed in a body. A keeper is formed with a strike plate behind which is positioned another body of magnetic material, or permanent magnet. When the door is placed in the closed position, the opposite polarity magnets attract each other pulling the latch mechanism into the doorjamb strike plate.

In a further embodiment, a cushioned stop is placed on the door stop and acts as a buffer to reduce or eliminate the noise of the door striking the door stop.

In another aspect of the invention, there is provided a door set assembly comprising a latch portion; a first magnetic material, located within the latch portion; a strike plate, the strike plate including a plate portion and a latch receiving portion; a second magnetic material, located within the latch receiving portion, the second magnetic material having a polarity opposite the first magnetic material; wherein when a door is closed, the magnets attract each other thereby pulling the latch portion into the latch receiving portion to secure the door closed.

The invention will be described or will become apparent in the course of the following detailed description and drawings of specific embodiments of the invention, as examples only.

BRIEF DESCRIPTION OF THE DRAWINGS

Embodiments of the invention will now be described, by way of example only, with reference to the attached drawings, in which.

DESCRIPTION OF THE INVENTION

Figure 1:
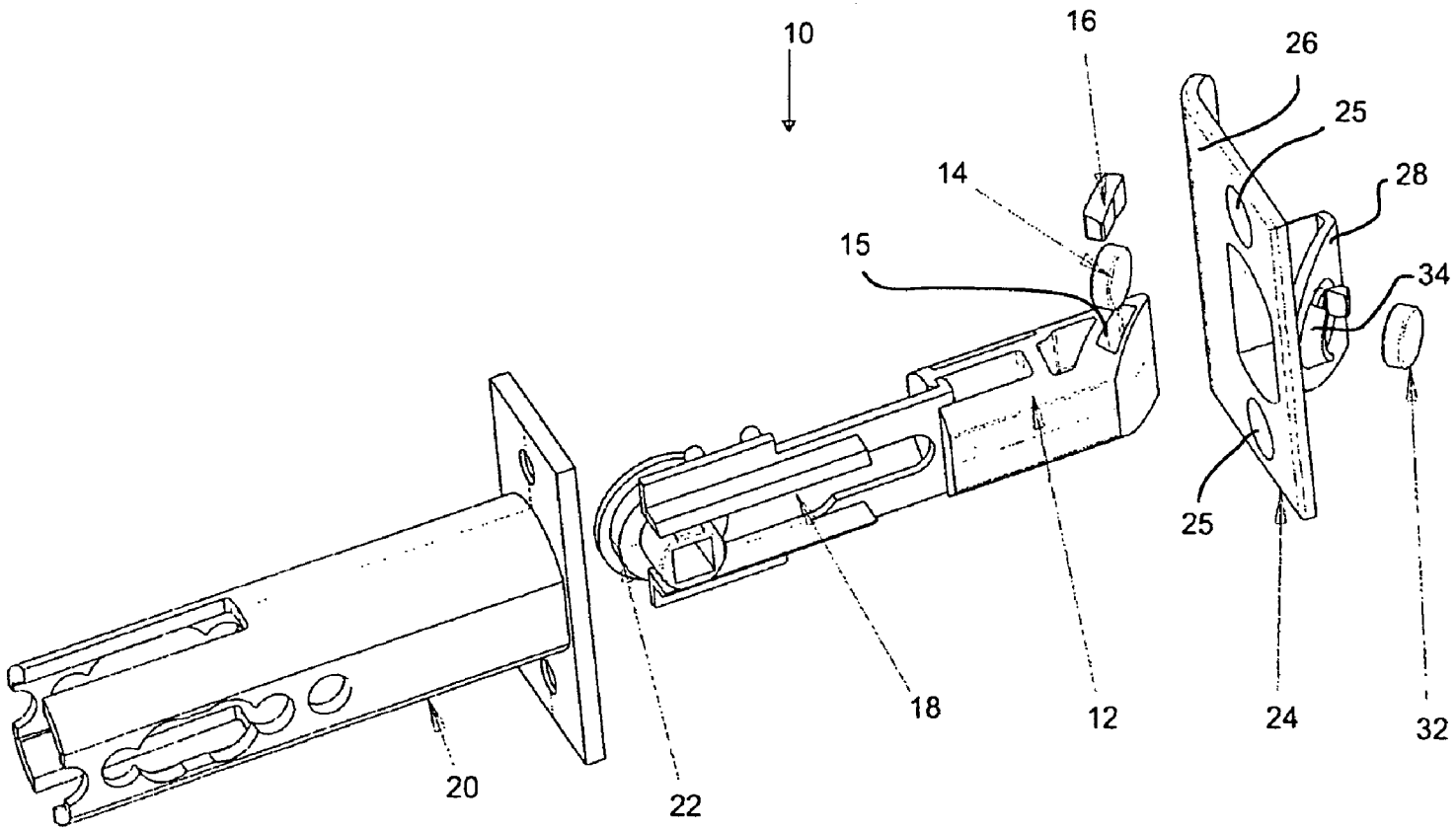
FIG. 1 is an exploded view of a first embodiment of a door set with magnetic actuator.

Turning to FIG. 1, an exploded perspective view of a first embodiment of a door set assembly is shown.

The door set assembly 10 includes a latch 12 with a first permanent magnet 14 installed in a slot 15 within the latch 12. The first permanent magnet 14 is held in place by a magnet retainer 16. The latch 12 is further connected to a release 18, preferably plastic, which allows the latch 12 to travel freely through a body portion 20 of the assembly 10 when a door knob (not shown) is turned to open the door within which the door set assembly 10 is installed.

The release 18 is also attached to a cam 22, which, when actuated by the turning of the door knob, draws the release 18 and the latch 12 into the body 20 so that it is recessed into the door. Connection between the door knob and the door set assembly will be understood by one skilled in the art. When actuated, the latch 12 remains recessed within the body portion 20, unlike a spring actuated latch that remains in the extended position unless the door knob is turned and held to recess the latch.

The mounting of a portion of the door set assembly to the door is preferably achieved via mechanical fasteners as will be understood by one skilled in the art, however other methods of mounting the door set assembly can be contemplated.

In the preferred embodiment, the door set assembly 10 includes a strike plate 24 which is typically installed through holes 25, into a door jamb. Mechanical fasteners, such as screws are typically inserted through the holes 25 to mount the strike plate 24 to the door jamb. The strike plate 24 includes a plate portion 26 and a latch receiving portion 28, the plate portion 26 including a hole for receiving the latch 12 into the latch receiving portion 28. A second permanent magnet, or magnetic material, 32, having a polarity opposite the first permanent magnet 14, is located at one end of the latch receiving portion 28 and is held in place by a magnet housing 34. In the current embodiment, the magnet housing 34 includes a pair of clips which provide a friction fit to hold the second magnet 32 in place. As the door closes, the second permanent magnet 32 attracts the first permanent magnet 14 in the latch 12 thereby drawing the latch into the latch receiving portion 28 inside the strike plate 24 and securely latching the door in the closed position.

During installation of the door set assembly, care must be taken to ensure that when both permanent magnets 14 and 32 are installed, they are inserted with the opposite polarity facing each other to draw the latch 12 into the strike plate 24 when the door is being closed.

Figure 2A:
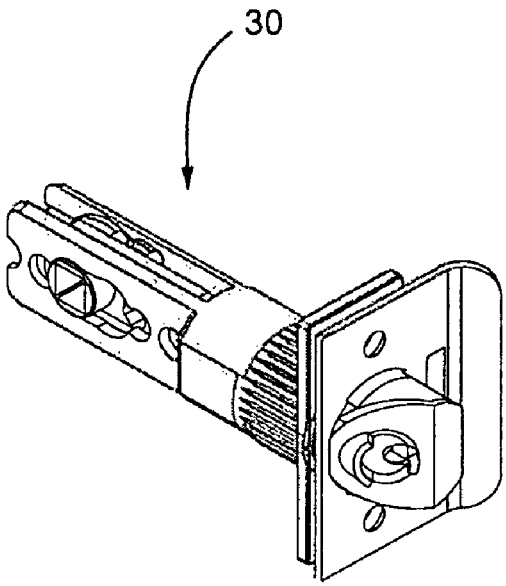
FIG. 2*a* is a front perspective view of another embodiment of a door set with magnetic actuator.
Figure 2B:
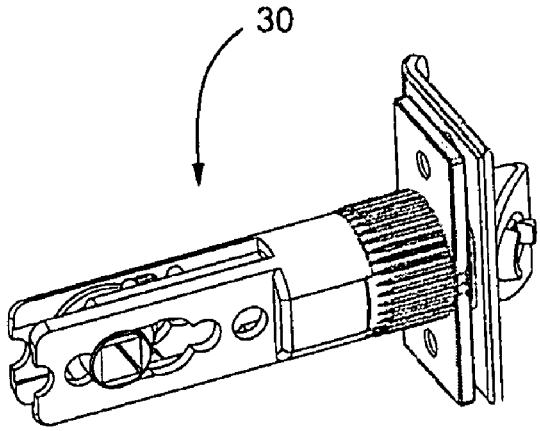
FIG. 2*b* is a rear perspective of the door set of FIG. 2*a*.
Figure 2C:
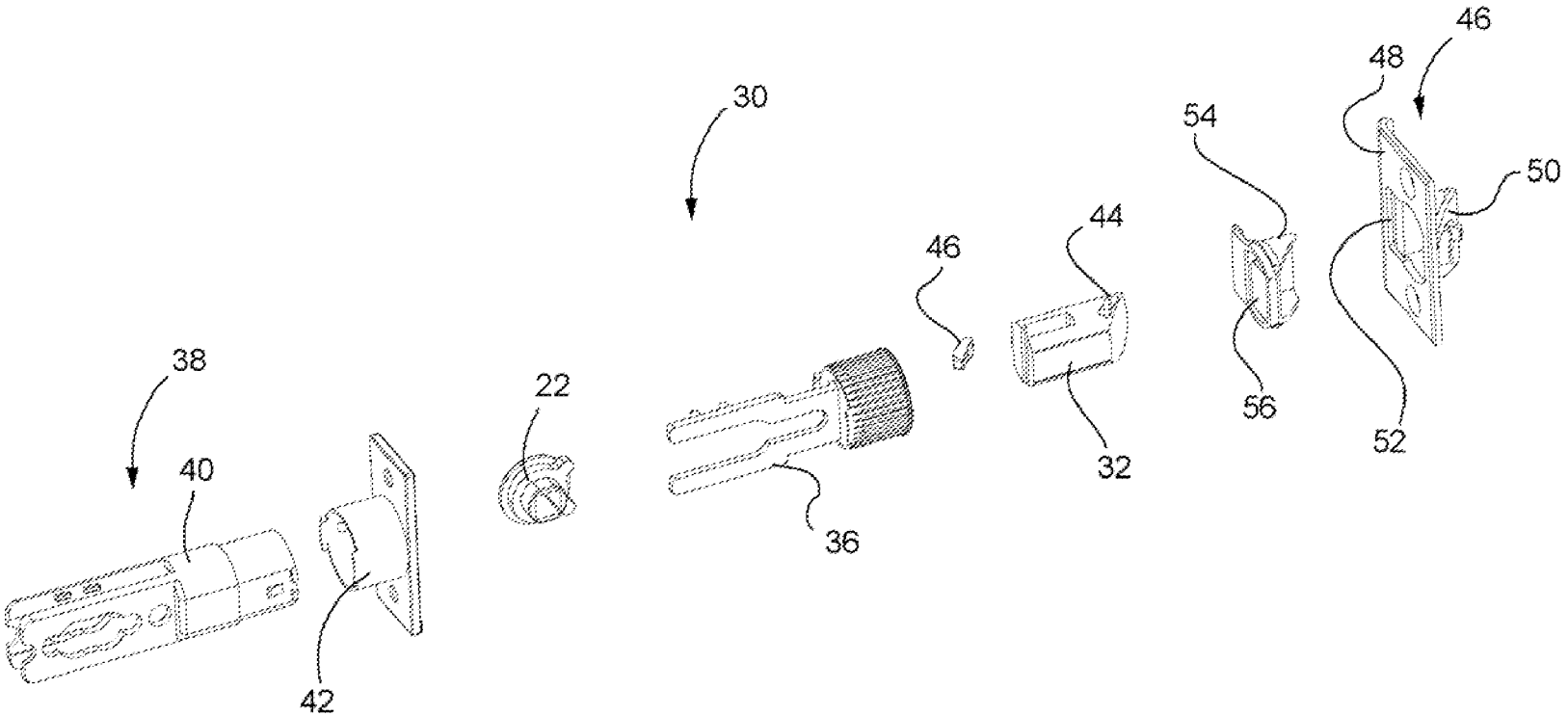
FIG. 2*c* is an exploded view of the door set of FIG. 2*a*.

Turning to FIGS. 2*a* to 2*c*, a second embodiment of a door set assembly is shown. FIGS. 2*a* and 2*b* provide perspective views of the assembly and FIG. 2*c* provides an exploded view.

As with the door set assembly disclosed above, the door set assembly 30 of FIG. 2*c* includes a latch portion 32, a cam portion 22, a release portion 36 and a two-part body portion 38 including housing portion 40 and receiving portion 42. The latch portion 32 includes a slot 44 for receiving a first permanent magnet (not shown) and a magnetic retainer 46.

The door set assembly 30 further includes a strike plate 46 including a plate portion 48 and a latch receiving portion 50. In the current embodiment, a groove 52 is formed into the strike plate 46 that allows a cushioning piece 54 to be placed in the strike plate 46 as the latch portion 32 travels through the latch receiving portion 50. The cushioning piece can be held in place by an adhesive backing located on a rear of the material and absorbs any impact the latch 32 can cause on the strike plate 24 thereby reducing any noise that could be generated when the latch is moving in and out of the strike plate 24.

In this embodiment, a small flap 56 is attached to the cushioning portion 54 and extends into the latch receiving portion 50 in the strike plate 46 to absorb any impact the latch 32 may make when entering the strike plate 46. The flap 56 can also work as a positive stop to limit the amount of travel the latch 32 can make thus reducing or eliminating any noise from the internal components such as by the release 36 striking the body portion 40 or the latch 32.

As will be understood, door set assemblies are installed in two possible configurations. Most are installed into 2⅜ inch or 2¾ inch center from the outside face of a door edge. In the preferred embodiment (as shown), the door set assembly 10 can be installed in either configuration as the body portion 20 has a sloped opening on the opposite end of the latch 12 which allows the cam 22 to be inserted into the opening attached to the release 18 and the latch 12 and clicks into the 2¾ inch position. If a 2⅜ inch configuration is required, the cam 22 can be turned in the opposite direction of the release appendages at the 2¾ inch position, allowing the cam 22 to slide forward in the body portion 20 to engage a second set of appendages in the 2⅜ inch position. This is same for the door assembly 30. Alternatively, the door set assembly 10 or 30 can be manufactured to fit only one of the two door configurations.

The combination of the body portion 20, the cam 22, the release 18 the first permanent magnet 14, the magnet retainer 16 and the latch 12 are assembled and installed into the door through the open end of the door edge with the strike plate 24 its components installed into the doorjamb a recess in the doorjamb at the same height combination. Once both assemblies are installed, the door can be swung shut.

In use, assuming the door is moving, or being swung, as the door is closing, various factors can contribute to the a slowing down of the door before it strikes the door stop of a doorjamb. As the door reaches the closed position, the two permanent magnets 14 and 32 attract each other drawing the latch 12 into the latch receiving portion 28 of the strike plate 24. The latch 12 moves freely out of the body portion 20 which is located inside the door. Movement of the latch 12 out of the body portion 20 causes the release 18 to also be drawn out along with it. As the strike plate 24 and the second magnet 32 are in a fixed position, all the movement of the assembly is performed by the latch 12 and release 18 along with the first permanent magnet 14 and magnet retainer 16. Movement of the latch into the latch receiving portion 28 securely fastens the door shut but does not involve a click from a spring loaded latch or a bang from the door hitting the door stop located on the door jamb thereby providing a quieter, or silent door set assembly.

To open the door, a standard door knob is turned either clock wise or counter clock wise to actuate the cam 22. Once the cam 22 is actuated it draws the release 18, and the latch 12 out of the strike plate 24 allowing the door to be pulled open. The force of the knob rotation, assists in overcoming the attraction of the two magnets.

After it has been drawn back into the body portion 20, the latch 12 remains recessed inside the body 20 along with the cam 22, release 18, first magnet 14 and the magnet retainer 16. As it is recessed it does not interfere with anyone or objects moving through the door opening. It remains recessed until such time that the door is moved into the closed position causing a recurrence of the steps described above An advantage of the current invention is that when a door is in the open position, the latch 12, release 18 and cam 22 are located in the door with no exposed parts.

In a further embodiment, the latch 12 includes a tapered portion on its end that engages the strike plate 24 which in conjunction with the cushion material allows the latch 12 to slide silently into the strike plate 24 with the cushion holding the door in place without rattling or striking the door stop located on the door jamb.

In an alternative embodiment, a cushion, or cushioned material, is installed on the door stop. The cushion is made of a shock absorbing material so when the door is moved into the closed position the cushion absorbs the force of the door prior to it striking the door stop of a standard door jamb.

As will be understood, the above discussion with respect to the door set assembly 10 and its individual parts can also be applied to the door set assembly 30 and its individual parts.

While the embodiments described herein are directed to particular implementations, it will be understood that modifications and variations to these embodiments are within the scope and sphere of the present application. Many other modifications and variations may occur to those skilled in the art. All such modifications and variations are believed to be within the sphere and scope of the present application.

We claim:

1. A door set assembly for use with a door, comprising:

a latch portion;

a first magnet enclosed within the latch portion;

an actuating mechanism for moving the latch portion;

a strike plate including a plate portion, a latch receiving portion extending from the plate portion, and a magnet holder positioned outside the latch receiving portion comprised of a pair of clips;

a second magnet enclosed within the magnet holder;

wherein when the door is closed, the latch portion is aligned with the latch receiving portion, the actuating mechanism will move the latch portion toward the latch receiving portion, and then the two magnets attract each other thereby pulling the latch portion into the latch receiving portion to secure the door closed.

2. The door set assembly of claim 1, wherein the actuating mechanism comprises:

a release portion connected to the latch portion; and a springless cam portion for actuating the latch portion.

3. The door set assembly of claim 1 further comprising a magnetic retainer for retaining the first magnet within the latch portion.

4. The door set assembly of claim 1 wherein the strike plate further comprises:

a cushioned material, located within the latch receiving portion for reducing the noise when the latch portion moves through the strike plate.

5. The door set assembly of claim 1 wherein the latch portion is mounted within a door and the strike plate is mounted in a door jamb.

6. The door set assembly of claim 2 wherein the release portion is manufactured from plastic.

7. The door set assembly of claim 1 further comprising a body portion for housing the latch portion.

8. The door set assembly of claim 7 wherein when the door is opened, the latch portion remains recessed within the body portion.

* * * * *